United States Patent [19]

Potter

[11] 4,350,268

[45] Sep. 21, 1982

[54] MANUALLY OPERATED DISPENSING PUMP

[75] Inventor: Charles Potter, Stow, Ohio

[73] Assignee: Go-Jo Industries, Inc., Akron, Ohio

[21] Appl. No.: 140,235

[22] Filed: Apr. 14, 1980

Related U.S. Application Data

[63] Continuation-in-part of Ser. No. 36,763, May 7, 1979, abandoned.

[51] Int. Cl.[3] ..... B65D 37/00

[52] U.S. Cl. ..... 222/214; 222/529; 417/477

[58] Field of Search ..... 222/180–182, 222/185, 207, 209, 212, 213, 214, 96, 529; 417/477

[56] References Cited

U.S. PATENT DOCUMENTS

| | | | |
|---|---|---|---|
| 1,765,360 | 6/1930 | Baumann | 222/209 |
| 2,668,637 | 2/1954 | Gilmore et al. . | |
| 2,909,125 | 10/1959 | Daniels . | |
| 3,066,832 | 12/1962 | Rossetti | 222/214 |
| 3,384,080 | 5/1968 | Mullet . | |
| 3,567,345 | 3/1971 | Ballentine et al. | 417/477 |
| 3,684,408 | 8/1972 | Maclin . | |
| 3,787,148 | 1/1974 | Kopf . | |
| 3,877,609 | 4/1975 | Cullis . | |
| 3,881,641 | 5/1975 | Pliml et al. . | |
| 4,070,725 | 1/1978 | Austin et al. . | |
| 4,228,930 | 10/1980 | Hogan | 222/212 |
| 4,274,558 | 6/1981 | Clausen | 222/214 |

*Primary Examiner*—H. Grant Skaggs
*Attorney, Agent, or Firm*—Reese Taylor

[57] ABSTRACT

A dispenser for use particularly with high viscosity or thixotropic materials and especially those containing grit is disclosed and comprises a two-piece housing adapted to be received on a supporting surface and to receive a replacable supply container for the material. The housing has an internal track at least partially disposed in a curved condition and intended to receive and support a flexible tube which interconnects the supply container and a dispensing nozzle which is carried by the housing. One of the housing components also carries a roller crank having a pair of diametrically opposed rollers which can be selectively moved into and out of occlusive contact with the tubing to force a measured amount of the material through the flexible tube and out the nozzle. A handle is disposed externally of the housing for connection with the roller crank for actuation thereof. The roller crank and the internal track are designed so that, except during the actual turning of the handle, the rollers are removed from occlusive contact with the tube so that it is in what may be called a relaxed condition.

3 Claims, 13 Drawing Figures

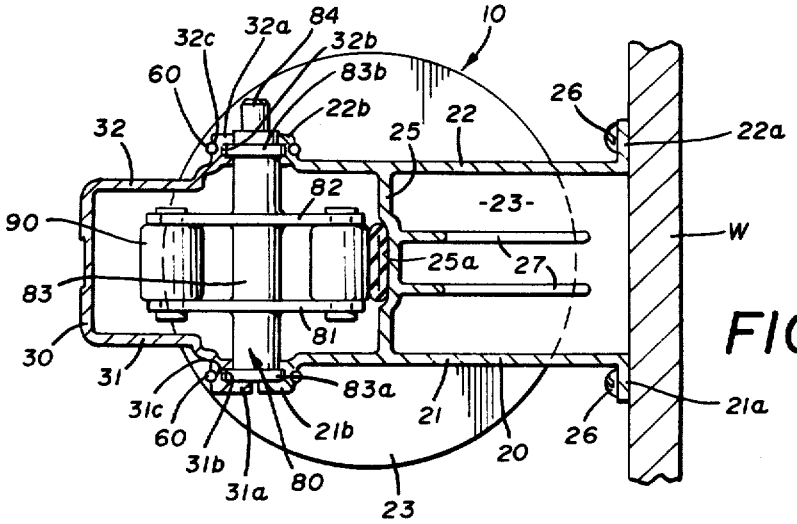
FIG. 7
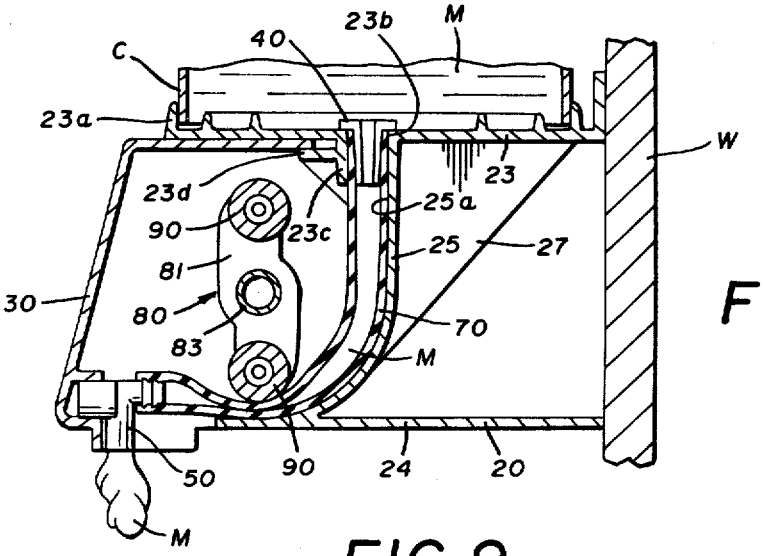
FIG. 8
FIG. 9
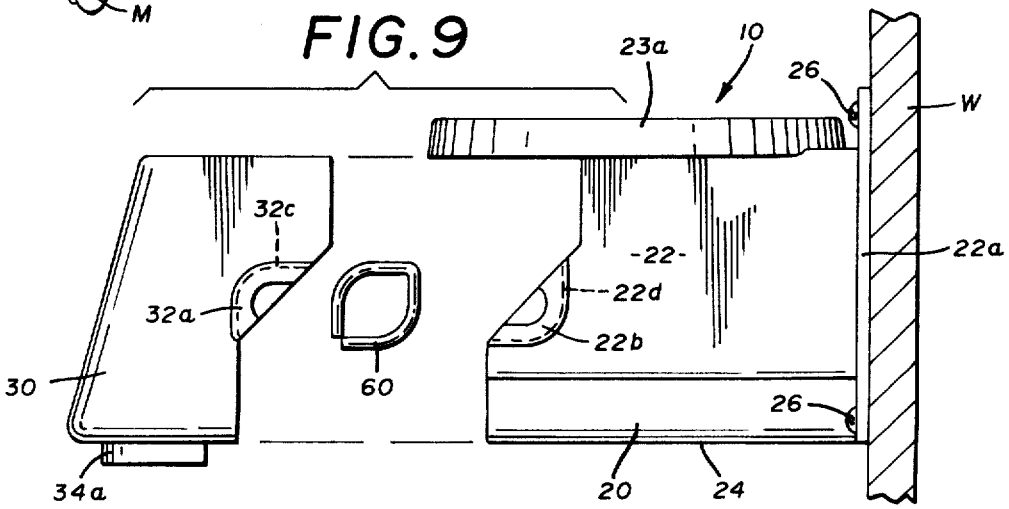

MANUALLY OPERATED DISPENSING PUMP

RELATED APPLICATIONS

This application is a continuation-in-part of my earlier filed, copending application Ser. No. 36,763, filed May 7, 1979 for Improved Dispenser now abandoned.

BACKGROUND OF THE INVENTION

This invention relates in general to dispensers and in particular to a dispenser adapted to receive a container or cartridge containing high viscosity or thixotropic material or containing particulate material and to dispense that material in measured amounts through a nozzle.

DESCRIPTION OF THE PRIOR ART

The present invention, broadly speaking, is a form of peristalic pump. The prior art is replete with peristalic pumps of various types commonly used for metering various types of materials.

Of interest in this regard is Gilmore U.S. Pat. No. 2,668,637 which discloses a discharge pump for dispensing heavy liquids and creams and utilizes a flexible, substantially nonelastic, normally collapsed bladder feeding material into a flexible tube. A rotor is provided containing a plurality of equally spaced rollers which can be moved along the tube toward the outlet to force the material through the nozzle.

Daniels U.S. Pat. No. 2,909,125 discloses a milk dispensing unit incorporating a tube which is acted upon by a roller assembly which includes spring-loaded rollers so as to create a suction to draw the milk from the supplying container and force it out of the discharge portion of the tube.

Muller U.S. Pat. No. 3,384,080 discloses the utilization of tubing placed on a semi-circular track and rollers which bear against the tubing to pump out the fluid.

Maclin U.S. Pat. No. 3,684,408 discloses a peristalic metering and dispensing pump wherein successive compression and release of flexible tubes which are disposed on a generally circular tube supporting surface by rollers compresses the tube to force the material out.

Kopf U.S. Pat. No. 3,787,148 discloses a roller pump having adjustable rollers with a track less than 180° and lead ramps disposed at the ends of the track to permit the reduction of occlusion at a specified point, the purpose being to insure that both rollers are not in full contact with the tube at the same time in order to reduce the torque required to drive the device.

Cullis U.S. Pat. No. 3,877,609 discloses a continuous flow arrangement wherein fluid is dispensed by distorting a flexible line.

Pliml U.S. Pat. No. 3,881,641 discloses the utilization of a flexible conduit which is compressed by utilization of spring-loaded rollers and arms.

Austin U.S. Pat. No. 4,070,725 also discloses a peristalic type pump having radially shiftable and retractable rollers.

Accordingly, from the aforementioned patent prior art it is apparent that peristalic type pumps employing rollers and flexible tubes are relatively well known in the art.

However, the prior art is generally relatively complex and in most instances involves pressing and contacting the tube at all times with the rollers so as to not only have the capability of dispensing the material from the tube, but also to have the capability of collapsing the tube and maintaining it in a closed position, or in other words, to trap a predetermined amount between the supply source and the discharge nozzle at all times. Also these prior art devices are generally not designed to handle high viscosity or thixotropic material or material containing grit.

SUMMARY OF THE INVENTION

It has been discovered that a much simplified and improved dispensing device can be obtained. It has been found that a simple two-piece housing arrangement can be provided with one of the housing components being attachable to a supporting surface and the other carrying the roller structure. It has been discovered that if a relatively simple roller crank arrangement having two diametrically opposed rollers is provided, the track on which the flexible tube lies can be designed so as to be curved through 90° and if properly spaced from the axle of the rollers, the rollers are only in occlusive contact with the tube during the dispensing operation.

This is found to be advantageous particularly with extremely high viscosity or thixotropic material since the material will not readily flow and there is no need to close off the tube by means of the rollers as is done in some prior art. This provides the additional advantage of increasing the longevity of the tube which has a tendency to take a permanent set thereby making it advantageous to only collapse the tube for the minimal amount of time necessary to dispense the particular material.

It has also been found that elimination of valving or other complicated structures are advantageous particularly when the material being dispensed has a substantial percentage of grit which would tend to plug up valves.

Accordingly, production of an improved dispenser of the type above described becomes the principal object of this invention with other objects thereof becoming apparent upon a reading of the following brief specification considered and interpreted in view of the accompanying drawings.

OF THE DRAWINGS

FIG. 7 is a sectional view of the roller assembly taken along the line 7—7 of FIG. 3.

FIG. 8 is a view similar to FIG. 3 showing the roller crank assembly near the end of its travel.

FIG. 9 is an exploded view similar to FIG. 1 showing the interconnection of the two housing components.

BRIEF DESCRIPTION OF THE PREFERRED EMBODIMENTS

Figure 1:
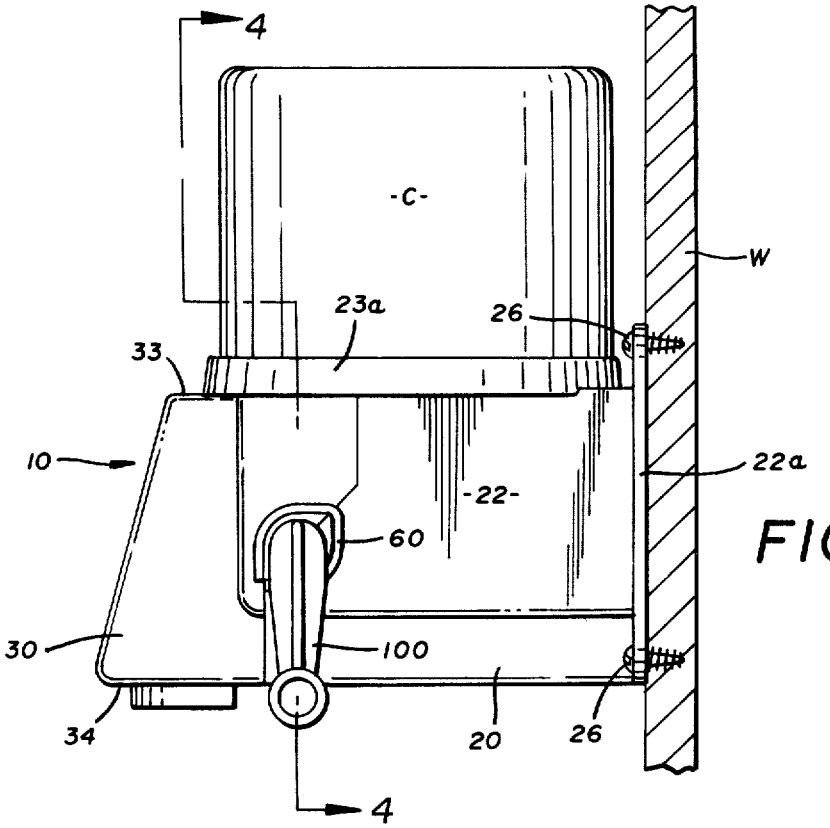
FIG. 1 is a side elevational view of the assembled dispenser.
Figure 2:
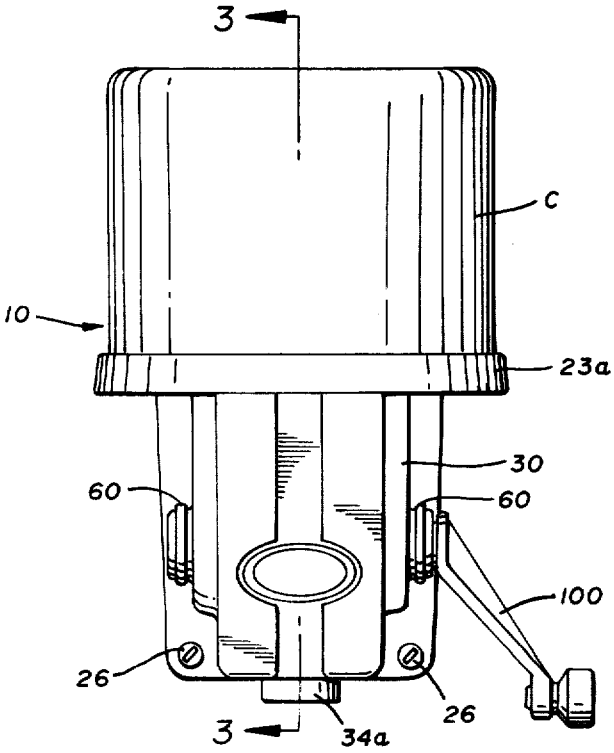
FIG. 2 is a front elevational view thereof.
Figure 6:
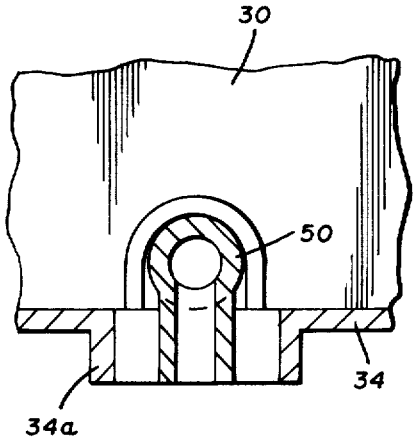
FIG. 6 is a sectional view of the nozzle taken along line 6—6 of FIG. 3.
Figure 3:
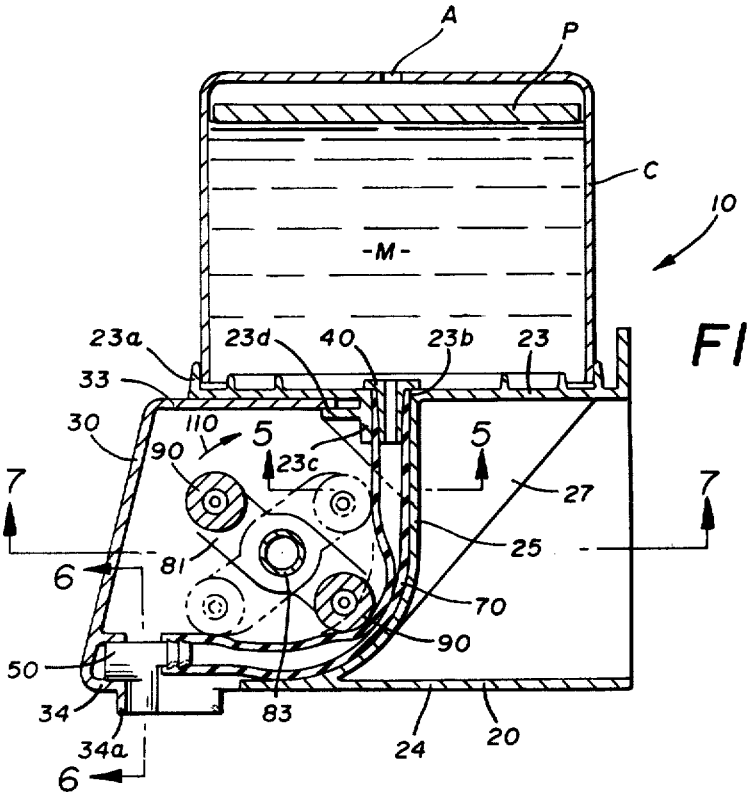
FIG. 3 is a sectional view taken along the line 3—3 of FIG. 2.

Referring first to FIGS. 1, 3 and 9, it will be noted that the dispenser, generally indicated by the numeral 10, includes a first housing component 20 and a second housing component 30.

First housing component 20 basically includes opposed sidewalls 21 and 22 and opposed top and bottom walls 23 and 24. These are interconnected by a cross wall or member 25 (See FIG. 7) which has projecting reinforcing members 27,27 formed integrally therewith.

Side walls 21 and 22 terminate in outwardly directed flanges 21*a* and 22*a* which are intended to receive screws 26,26 for purposes of attaching the first housing component 20 to the supporting surface W.

Top wall 23 has an annular projection or flange 23*a* which is of suitable size to receive the material supply source C which is essentially a cartridge or container which contains the material M. As clearly shown in FIGS. 1 and 3, to load the dispenser it is simply necessary to remove the lid of the container C, open aperture A and invert it into the annular flange 23*a* of the top wall 23. The follow plate P and atmospheric pressure will then act on the material M.

Top wall 23 also has a central opening 23*b* which opens into a tubular dependency 23*c* which, in turn, receives a plug 40 for purposes which will be described.

Furthermore, cross member 25 which extends from top wall 23 to bottom wall 24 and between side walls 21 and 22 has a ninety degree (90°) arcuate configuration throughout a portion of its length and has a central depression 25*a* (See FIG. 7) which serves as a track or carrier for the flexible tube 70 as clearly shown in FIGS. 3 and 7 of the drawings.

Tube 70 has one end fitted within dependency 23*c* and about the hollow plug 40 so that it is firmly held in place in fluid communication with the interior of the container C through central openings 23*a* of top wall 23.

The second housing component 30 also includes opposed side walls 31 and 32 and top and bottom walls 33 and 34. Top wall 33 thereof is dimensioned so that when the housing components are assembled it will fit beneath the top wall 23 of the first housing component and be received in the space between that wall and the horizontal projection 23*d* thereof.

The bottom wall 34 of the second housing component 30 also includes a dispensing spout 34*a* which receives nozzle 50 and this nozzle is intended to connect to the opposed end of the flexible tube 70 as shown in FIG. 3.

Figure 4:
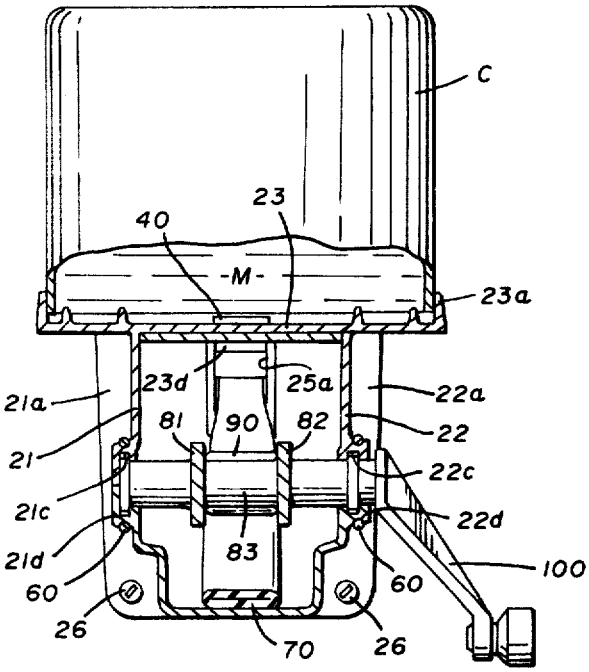
FIG. 4 is a partial sectional view taken along the line 4—4 of FIG. 1.
Figure 5:
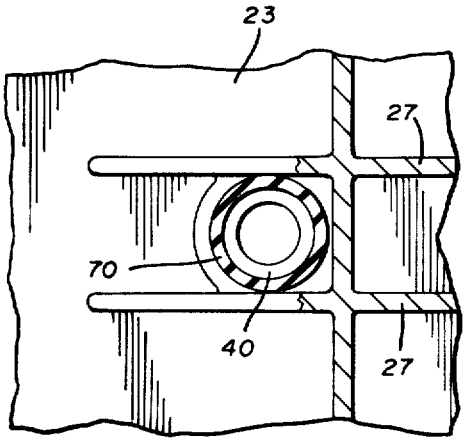
FIG. 5 is a sectional view taken along the line 5—5 of FIG. 3.

It should also be noted, with reference to FIG. 4, that the side walls 21 and 22 of first housing member 20 have projections 21*b*,22*b* on their leading edges and extending outwardly. These projections have internal grooves 21*c*,22*c* which form half of the seats for receipt of the roller crank assembly which will be described later. These extensions of the side walls 21 and 22 also have external annular grooves 21*d*,22*d* for receipt of the spring clips 60,60 which will also be described below.

Second housing component 30 has similar projections 31*a* and 32*a* on the edges of its side walls so that when the housing components 20 and 30 and the projections 21*b* and 31*a* and 22*b* and 32*a* are placed against each other a complete seat for the roller crank assembly axle will be provided. It should be noted that the opening thus formed is not truly circular with such structure facilitating removal from the molds during manufacturing. This also has an advantage in the clamping action, as will be described.

Additionally, the projections 31*a* and 32*a* have internal grooves 31*b*,32*b* and external grooves 31*c*,32*c* to receive the roller crank assembly and the spring clips 60,60.

Turning then to FIGS. 4 and 7 for a description of the roller crank assembly 80, it will be noted that this assembly includes a pair of opposed arms 81 and 82 which are either integral with or firmly secured to an axle member 83 which has a length dimension sufficient to span the distance between the side walls of the first and second housing components as clearly shown in FIGS. 4 and 7 of the drawings. Journaled between the ends of arms 81 and 82 are rollers 90,90 which are freely rotatable about their axes of support and disposed diametrically from each other.

The axle 83 of the roller crank assembly 80 has integral bushings 83*a*,83*b* disposed on its opposed ends and these are intended to be received in the annular internal grooves of the side wall projections 21*b*,22*b* and 31*a*,32*a* of the first and second housing components so that in this fashion it is possible to support the axle 83 for rotation about its axis.

The axle 83 also has a handle receiving projection 84 extending from one end thereof beyond the housing sidewalls to receive handle 100.

In use or operation of the improved assembly, it will first be assumed that the flexible tube 70 has been secured within the tubular dependency 23*b* of the top wall 23 and that the hollow plug 40 has been inserted to hold one end of the tube in place. The tube will then have been laid along the depression 25*a* of the cross member 25 which forms a track therefor.

The second housing component 30 is then ready for assembly and it would first be necessary to engage the opposed end of the tube 70 with the nozzle 50 which is seated in dispensing spout 34*a*. Following that, the second housing component 30 is engaged with the first housing component 20 and secured thereto by the spring clips 60,60. These clips are received in grooves 21*c*,22*c* and 31*b*,32*b* and are designed so that they have adequate strength to hold the components 20 and 30 together and yet are capable of slight expansion to allow for variations in either the dimensions of the tube or the dimensions of the crank axle. The clips are designed to apply clamping pressure diagonally across the projections and the non-circular nature of the projections facilitates this.

During assembly of components 20 and 30, of course, the bushings 83*a* and 83*b* of the axle will be received in the suitable internal grooves 21*d*,22*d*,31*c*,32*c* in the projections on the side walls of the two components and once the spring clips have been installed it is simply necessary to attach the handle 100 to the handle receiving projection 84 of the axle by any suitable means.

The entire assembly can then be secured to the supporting surface W by means of screws 26,26.

The container C is then inverted and placed in the annular flange 23*a* at which time the dispenser is ready for operation.

Assuming the crank assembly to be in the position of FIG. 3, turning the handle 100 will, of course, turn the roller crank assembly 80 in the direction of the arrow 110 and it has been found that, assuming the rotor assembly to be out of occlusive contact with the tubing at the beginning of the turn, a turn of approximately 180° will move the roller along the tube to the position of FIG. 8, or in other words, into occlusive contact with the tubing thereby dispensing a predetermined amount of the material M. A further slight turning beyond the position of FIG. 8 will free whichever roller 90 which had been in occlusive contact with the tube, from such contact prior to any such contact being made by the other roller 90 so that unless the dispenser is actually being used, the rollers are not in occlusive contact with the tubing and the tubing is allowed to return to its normal condition.

Turning next then to FIGS. 10 through 13 of the drawings, a modified form of the invention is illustrated. Similar numbers have been applied to similar elements of the invention for the sake of clarity.

Accordingly, the basic components of the housing members 20 and 30 are identical as is the roller crank assembly 80 which carries the rollers 90—90 and the tubing 70.

Where this form of the invention differs is in the arrangement and function of the nozzle.

Figure 10:
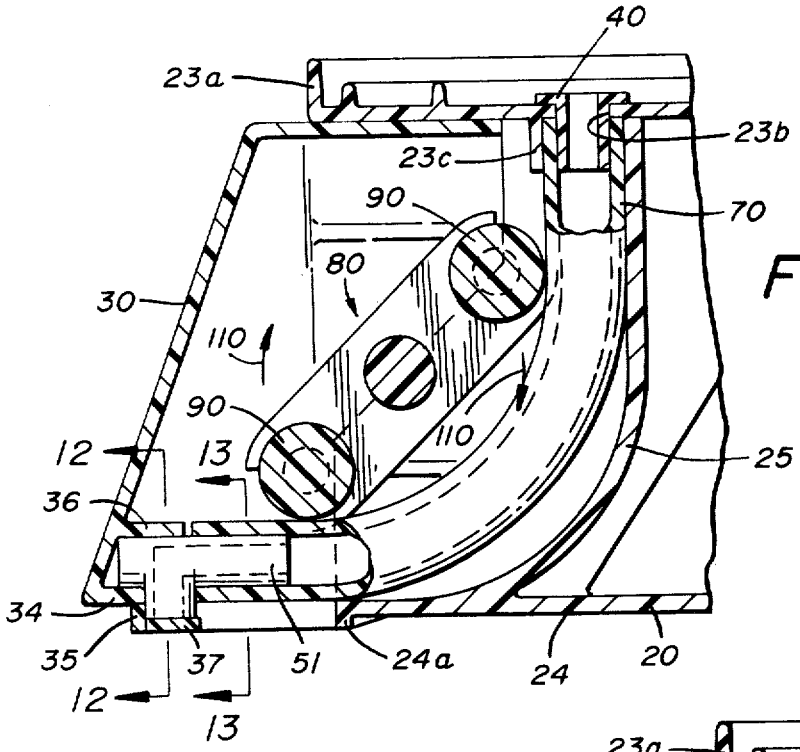
FIG. 10 is a sectional view similar to the view of FIG. 3 showing a modified version of the invention.
Figure 12:
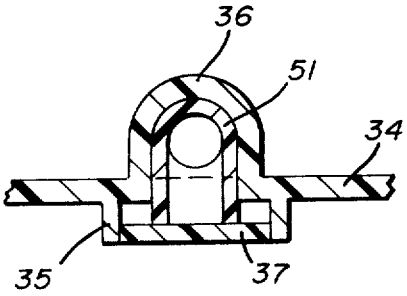
FIG. 12 is a sectional view taken along the line 12—12 of FIG. 10.
Figure 11:
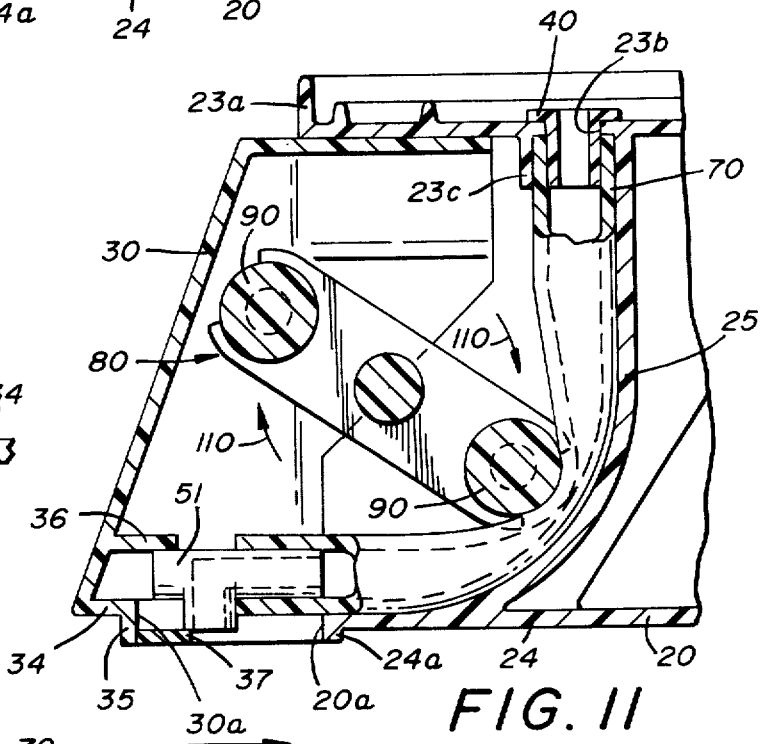
FIG. 11 is a sectional view of the modification of FIG. 10 with the roller crank assembly in contact with the tube.
Figure 13:
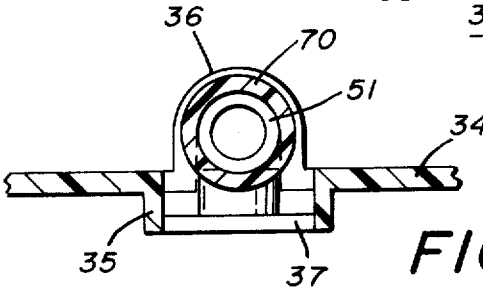
FIG. 13 is a sectional view taken along the line 13—13 of FIG. 10.

Accordingly, reference to FIGS. 10 and 11 will illustrate clearly that nozzle 51 is fit into the free end of the tube 70. That nozzle is not secured to the housing 30 in any way.

Housing 30 has an inwardly extending U-shaped member 36 which is illustrated in FIG. 10 as receiving one end of the nozzle 51. The other end of the nozzle 51 is, of course, received within the tube 70.

The housing 30 has an opening **30*a* in its bottom wall 34 and at one end of this opening there is a downwardly projection member 35**.

Housing 20 also has an opening **20*a* in its bottom wall 24 and a downwardly projecting member 24*a***.

Secured to and projecting normally to the longitudinal axis of the member 35 is a sealing and wiping plate 37, which closes off or extends throughout the length of at least a part of the opening **30*a***.

Referring to FIG. 10, it will be noted that in that view the crank assembly has been turned so that the assembly is out of occlusive contact with the tubing and the nozzle 51 is resting on the top surface of the sealing and wiping plate 37, which thereby closes off the end to avoid dripping in effect, that plate services as a valve.

As the roller crank assembly 80 is rotated in the direction of the arrows 110,110, it will force the tube 70 and the nozzle 51 to the right of FIG. 11 in the direction of the arrow 120, thereby moving the nozzle 51 off of the plate 37 and permitting the material M to be dispensed.

As the roller crank assembly 80 continues rotation, the tube and the nozzle will tend to move back to the left of FIG. 11 and the open end of the nozzle will slide onto the plate 37 which at that point services a wiping function.

As noted above, the remaining structural elements and operation of the device illustrated in FIGS. 10 through 13 are the same as those described above in connection with the embodiment of the illustrated in FIGS. 1 through 9.

While a full and complete description of the invention has been set forth in accordance with the dictates of the Patent Statutes, it should be understood that modifications can be resorted without departing from the spirit hereof or the scope of the appended claims.

Thus it should be noted that while the dispenser has been illustrated as being mounted on the vertical wall surface W, that other forms of mounting could be resorted to.

Furthermore, while reference has been made to a "ninety degree (90°)" arc on cross member 25, it should be understood that the invention is not intended to be precisely limited to that specific length and reasonable variations as may be resorted to without impairing the inventive concept.

Similarly, the invention of FIGS. 1 through 9 is not intended to be limited to the two rollers 90,90 illustrated since more or less rollers could be employed so long as the rollers are disposed so as to be in occlusive contact with the tube during only the desired period of time and for the desired length of travel.

What is claimed is:

1. A dispenser designed to receive a material supply source, comprising:

(A) a first housing component adapted to support the material supply source;

(B) a second housing component releasably engagable with said first housing components;

(C) an outlet nozzle carried by said second housing component;

(D) flexible tubular means interconnecting the material supply source and said nozzle;

(E) roller crank means carried within said first and second housing components for selective movement into and out of occlusive contact with said flexible tubular means;

(F) said outlet nozzle being movable with respect to said first and second housing components upon movement of said roller crank means;

(G) said second housing having an opening in its bottom wall and a wiping and sealing plate secured to said second housing and closing off a portion of said opening; and (H) said outlet nozzle being moved into and out of engagement with said plate in response to said movement of said roller crank means.

2. A dispenser designed to receive a material supply source, comprising:

(A) a first housing component having
  (1) opposed top and bottom walls and
  (2) opposed side walls;

(B) a seating flange projecting from said top wall for receipt of the material supply source;

(C) an internal support member
  (1) extending from said top wall to said bottom wall and
  (2) having an approximately 90° curve throughout a part of its length;

(D) a second housing component releasably engagable with said first housing component;

(E) nozzle means carried by said second housing component;

(F) flexible tubular means
  (1) supported by said internal support member and
  (2) interconnecting the material supply source and said nozzle;

(G) roller crank means carried by said first and second housing components and movable into and out of occlusive contact with said flexible tubular means;

(H) said nozzle means being movable with respect to said first and second housing components upon movement of said roller crank means;

(I) said second housing having an opening in its bottom wall and a wiping and sealing plate secured to said second housing and closing off a portion of said opening; and (J) said nozzle being moved into and out of engagement with said plate in response to said movement of said roller crank means.

3. A dispenser designed to receive a material supply source, comprising:

(A) a first housing component adapted to support the material supply source;

(B) a second housing component releasably engagable with said first housing component;

(C) an outlet nozzle carried by said second housing component;

(D) flexible tubular means interconnecting the material supply source and said nozzle;

(E) roller crank means carried within said first and second housing components for selective movement between positions of occlusive contact with said flexible tubular means and non-occlusive contact therewith;

(F) said second housing component having opposed top and bottom walls and opposed side walls;

(G) said roller crank means including (1) an elongate axle spanning the distance between said side walls of said first and second housing components, (2) a pair of rollers mounted on said axle in diametrically projecting relationship therewith;

(H) each of said first and second housing components having complemental seating projections on its side walls;

(I) said axle having its opposed ends supported by said seating projections;

(J) said seating projections including grooves about their peripheries;

(K) spring clip means releasably engagable with said grooves;

(L) said seating projections forming a generally rectangular planar configuration when said first and second housing components are engaged; and (M) said spring clip means being generally U-shaped and applying clamping pressure diagonally across said seating projections.

* * * * *